US008836627B2

(12) United States Patent
Huang et al.

(10) Patent No.: US 8,836,627 B2
(45) Date of Patent: Sep. 16, 2014

(54) LIQUID CRYSTAL DISPLAY APPARATUS FOR DRIVING PIXEL ARRAY AND PIXEL DRIVING METHOD

(75) Inventors: Tien-Chin Huang, Hsinchu (TW); Chia-Tsung Chaing, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 302 days.

(21) Appl. No.: 13/274,485

(22) Filed: Oct. 17, 2011

(65) Prior Publication Data

US 2012/0169687 A1 Jul. 5, 2012

(30) Foreign Application Priority Data

Dec. 31, 2010 (TW) ..... 99147292 A

(51) Int. Cl.
*G09G 3/36* (2006.01)

(52) U.S. Cl.
CPC ..... *G09G 3/3677* (2013.01); *G09G 2310/08* (2013.01); *G09G 2330/021* (2013.01); *G09G 2310/0202* (2013.01); *G09G 3/3614* (2013.01)
USPC ..... 345/96; 345/209

(58) Field of Classification Search
CPC ..... G09G 3/3677
USPC ..... 345/96, 208, 209
See application file for complete search history.

(56) References Cited

U.S. PATENT DOCUMENTS

| | | | | |
|---|---|---|---|---|
| 7,385,576 | B2 * | 6/2008 | Moon | 345/87 |
| 8,416,232 | B2 * | 4/2013 | Nam et al. | 345/213 |
| 2007/0247478 | A1 | 10/2007 | Hagino et al. | |
| 2008/0013005 | A1 | 1/2008 | Deane | |
| 2010/0156947 | A1 * | 6/2010 | Moon et al. | 345/690 |
| 2010/0277494 | A1 * | 11/2010 | Cho et al. | 345/589 |

FOREIGN PATENT DOCUMENTS

| | | | |
|---|---|---|---|
| CN | 1985297 | A | 6/2007 |
| CN | 101027713 | A | 8/2007 |
| CN | 101763837 | A | 6/2010 |

OTHER PUBLICATIONS

China Office Action dated Apr. 26, 2012.

* cited by examiner

*Primary Examiner* — Kwang-Su Yang
(74) *Attorney, Agent, or Firm* — McClure, Qualey & Rodack, LLP

(57) ABSTRACT

A liquid crystal display apparatus and a pixel driving method are provided. The liquid crystal display apparatus comprises a pixel array, a scan driving circuit and a data driving circuit. The pixel array comprises a plurality of first pixels, a plurality of second pixels, a plurality of third pixels and a plurality of fourth pixels. The scan driving circuit is configured to activate the first pixels and the fourth pixels sequentially and then activate the second pixels and the third pixels sequentially. The data driving circuit is configured to supply a first polarity data signal when the first pixels and the fourth pixels are activated and supply a second polarity data signal when the second pixels and the third pixels are activated.

11 Claims, 8 Drawing Sheets

LIQUID CRYSTAL DISPLAY APPARATUS FOR DRIVING PIXEL ARRAY AND PIXEL DRIVING METHOD

This application claims priority to Taiwan Patent Application No. 099147292 filed on Dec. 31, 2010, which is hereby incorporated by reference in its entirety.

CROSS-REFERENCES TO RELATED APPLICATIONS

Not applicable.

BACKGROUND OF THE INVENTION

1. Field of the Invention

The present invention relates to a liquid crystal display apparatus and a pixel driving method. More particularly, the present invention relates to a liquid crystal display apparatus for driving a pixel array and a pixel driving method.

2. Descriptions of the Related Art

In recent years, as the flat panel display technologies become increasingly matured, the flat panel displays have gradually replaced the traditional cathode ray tube (CRT) displays. Among various kinds of flat panel displays, the liquid crystal display (LCD) is a kind of flat panel display having such advantages as a high resolution, a thin profile, a light weight and low power consumption. Thanks to the efforts made by the display manufacturers, the display performance and production capacity of the liquid crystal displays as well as the price competitiveness thereof compared to other kinds of flat panel displays have been significantly improved. As a result, the market share of the liquid crystal displays has experienced a rapid expansion, and the liquid crystal displays have become the mainstream product in the flat panel display market.

Generally, each of pixels included in an LCD requires to be applied with a driving voltage to supply an electric field for aligning liquid crystal molecules in the pixel so that the liquid crystal molecules can be aligned to display frames at various luminance levels and contrast ratios. In order to avoid the direct current (DC) residue, the LCDs are all driven in an alternating current (AC) mode; i.e., a voltage which alternates between a positive polarity and a negative polarity continuously is used to drive the liquid crystal molecules in the pixel. However, when the driving voltage switches from the positive polarity to the negative polarity or vice versa, consumption of a certain amount of energy must occur. Therefore, the higher the switching frequency of the driving voltage is, the greater the corresponding energy loss will be.

Currently, the LCDs are generally driven in a column inversion mode or a dot inversion mode. By the "column inversion mode", it means that pixels in a same vertical line have the same polarity and pixels in adjacent vertical lines have the opposite polarity; and by the "dot inversion mode", it means that any two adjacent pixels have the opposite polarities. Because the column inversion mode presents a polarity switching frequency that is only a half of that of the dot inversion mode, it has lower power consumption. However, in the column inversion mode, pixels in a same column all have the same polarity, so a disadvantage of V-line Mura in the vertical direction will occur in the frame; on the other hand, although the dot inversion mode will not result in V-line Mura in the vertical direction, it has higher power consumption.

Accordingly, an urgent need exists in the art to provide a pixel driving method that can overcome the disadvantage of V-line Mura in the vertical direction while still keeping the power-saving advantage of the column inversion mode.

SUMMARY OF THE INVENTION

An objective of the present invention is to provide a liquid crystal display (LCD) apparatus. The LCD apparatus comprises a pixel array, a scan driving circuit and a data driving circuit. The pixel array comprises a $(4m+1)^{th}$ scan line, a $(4m+2)^{th}$ scan line, a $(4m+3)^{th}$ scan line, a $(4m+4)^{th}$ scan line, a data line, a plurality of first pixels, a plurality of second pixels, a plurality of third pixels and a plurality of fourth pixels. The first pixels and the second pixels are disposed between the $(4m+1)^{th}$ scan line and the $(4m+2)^{th}$ scan line, the first pixels are electrically connected to the $(4m+1)^{th}$ scan line, the second pixels are electrically connected to the $(4m+2)^{th}$ scan line, the third pixels and the fourth pixels are disposed between the $(4m+3)^{th}$ scan line and the $(4m+4)^{th}$ scan line, the third pixels are electrically connected to the $(4m+3)^{th}$ scan line, and the fourth pixels are electrically connected to the $(4m+4)^{th}$ scan line. The data line is disposed between the first pixels and the second pixels and between the third pixels and the fourth pixels, and the data line is electrically connected to the first pixels, the second pixels, the third pixels and the fourth pixels.

The scan driving circuit is electrically connected to the $(4m+1)^{th}$ scan line, the $(4m+2)^{th}$ scan line, the $(4m+3)^{th}$ scan line and the $(4m+4)^{th}$ scan line. The scan driving circuit is configured to supply a driving signal to the $(4m+1)^{th}$ scan line and the $(4m+4)^{th}$ scan line in an ascending order of a value of m to activate the first pixels and the fourth pixels, and then sequentially supply the driving signal to the $(4m+2)^{th}$ scan line and the $(4m+3)^{th}$ scan line in an ascending order of the value of m to activate the second pixels and the third pixels or sequentially supply the driving signal to the $(4m+3)^{th}$ scan line and the $(4m+2)^{th}$ scan line in a descending order of the value of m to activate the third pixels and the second pixels.

The data driving circuit is electrically connected to the data line, and is configured to supply a first polarity data signal to the data line to enable the first pixels and the fourth pixels to present a first polarity when the first pixels and the fourth pixels are activated, and supply a second polarity data signal to the data line to enable the second pixels and the third pixels to present a second polarity when the second pixels and the third pixels are activated. The pixel array has an overall scan line amount N, m includes integers ranging from 0 to N/4−1, and the first polarity is opposite to the second polarity.

Another objective of the present invention is to provide a pixel driving method for use in the aforesaid liquid crystal display apparatus. The pixel driving method comprises the following steps of: (a) enabling the scan driving circuit to supply a driving signal to the $(4m+1)^{th}$ scan line and the $(4m+4)^{th}$ scan line in an ascending order of the value of m to activate the first pixels and the fourth pixels; (b) enabling the scan driving circuit to sequentially supply the driving signal to the $(4m+2)^{th}$ scan line and the $(4m+3)^{th}$ scan line in an ascending order of the value of m to activate the second pixels and the third pixels or sequentially supply the driving signal to the $(4m+3)^{th}$ scan line and the $(4m+2)^{th}$ scan line in a descending order of the value of m to activate the third pixels and the second pixels; (c) enabling the data driving circuit to supply a first polarity data signal to the data line to enable the first pixels and the fourth pixels to present a first polarity when the first pixels and the fourth pixels are activated; and (d) enabling the data driving circuit to supply a second polarity data signal to the data line to enable the second pixels and the third pixels to present a second polarity when the second pixels and the third pixels are activated. The pixel array has an overall scan line amount N, m includes integers ranging from 0 to N/4−1, and the first polarity is opposite to the second polarity.

According to the LCD apparatus of the present invention, the first pixels and the fourth pixels are activated in an ascending order of the value of m and, then, the second pixels and the third pixels are sequentially activated in an ascending order of the value of m or the third pixels and the second pixels are sequentially activated in a descending order of the value of m. Further, when the first pixels and the fourth pixels are activated, a first polarity data signal is supplied to enable the first pixels and the fourth pixels to present a first polarity; and when the second pixels and the third pixels are activated, a second polarity data signal is supplied to enable the second pixels and the third pixels to present a second polarity. Thereby, the present invention can overcome the disadvantage of the prior art column inversion driving mode that V-line Mura occurs in the vertical direction in the frame while still having the power-saving advantage of the column inversion driving mode.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

In the following descriptions, the present invention will be explained with reference to embodiments thereof. However, these embodiments are not intended to limit the present invention to any specific environment, applications or particular implementations described in these embodiments. Therefore, description of these embodiments is only for purpose of illustration rather than to limit the present invention. It should be appreciated that, in the following embodiments and the attached drawings, elements not directly related to the present invention are omitted from depiction; and dimensional relationships among individual elements in the attached drawings are illustrated only for ease of understanding, but not to limit the actual scale.

Figure 1:
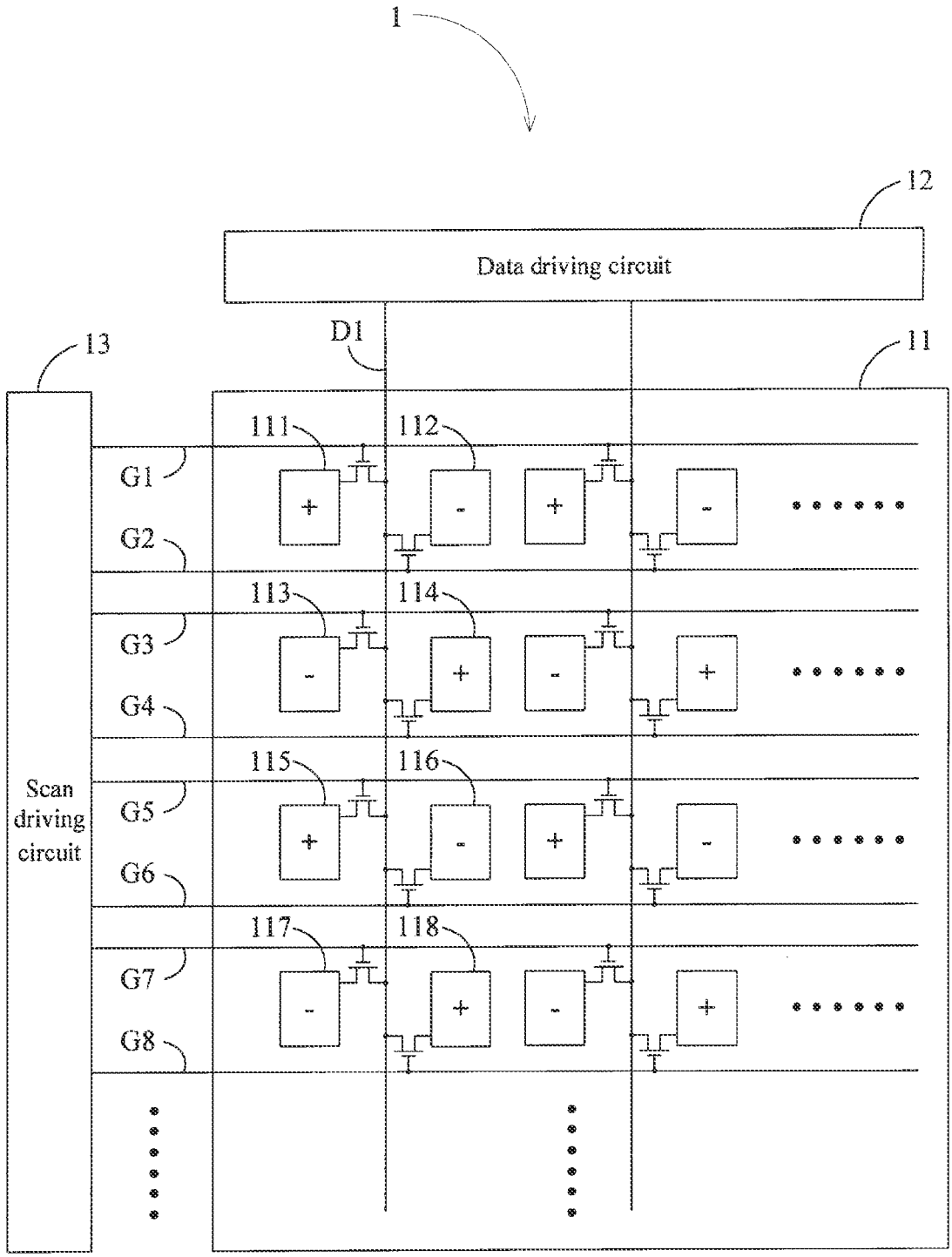
FIG. 1 is a schematic view of a first embodiment of the present invention.

A first embodiment of the present invention is a liquid crystal display (LCD) apparatus 1, a schematic view of which is depicted in FIG. 1. The LCD apparatus 1 comprises a pixel array 11, a scan driving circuit 13 and a data driving circuit 12. The pixel array 11 further comprises a plurality of pixels, a plurality of scan lines and a plurality of data lines. The scan lines are electrically connected to the scan driving circuit 13, and the data lines are electrically connected to the data driving circuit 12.

In this embodiment, the pixel array 11 is a pixel array having 800×600 pixels. In other words, the pixel array 11 has 800 pixels in each row along the horizontal direction and 600 pixels in each column along the vertical direction. As shown in FIG. 1, the pixel array 11 of this embodiment adopts a half source driver (HSD) connection scheme, i.e., every two horizontally adjacent pixels are driven by two scan lines and one data line. Therefore, 1200 scan lines and 400 data lines must be used to drive the 800×600 pixels in the pixel array 11 of the LCD apparatus 1. In other embodiments, the pixel array 11 may also be of any other size, and the size of the pixel array is not intended to limit the scope of the present invention.

For purpose of describing the technical features of the present invention, the 1200 scan lines will be denoted by variable serial numbers in this specification. To be more specific, the pixel array 11 comprises a $(4m+1)^{th}$ scan line, a $(4m+2)^{th}$ scan line, a $(4m+3)^{th}$ scan line and a $(4m+4)^{th}$ scan line, and comprises N scan lines in total, i.e., N is a total scan line amount of the pixel array 11. Here, possible values of m include integers ranging from 0 to N/4−1; and in this embodiment, N=1200, and m is an integer ranging from 0 to 299, i.e., 0, 1, 2, . . . , 298, and 299. Therefore, when m=0, the $(4m+1)^{th}$ scan line is the first scan line G1, the $(4m+2)^{th}$ scan line is the second scan line G2, the $(4m+3)^{th}$ scan line is the third scan line G3, and the $(4m+4)^{th}$ scan line is the fourth scan line G4; when m=1, the $(4m+1)^{th}$ scan line is the fifth scan line G5; when m=299, the $(4m+4)^{th}$ scan line is the $1200^{th}$ scan line; and so on.

The pixel array 11 further comprises a data line, a plurality of first pixels, a plurality of second pixels, a plurality of third pixels and a plurality of fourth pixels. The first pixels and the second pixels are disposed between the $(4m+1)^{th}$ scan line and the $(4m+2)^{th}$ scan line. The first pixels are electrically connected to the $(4m+1)^{th}$ scan line, and the second pixels are electrically connected to the $(4m+2)^{th}$ scan line. The third pixels and the fourth pixels are disposed between the $(4m+3)^{th}$ scan line and the $(4m+4)^{th}$ scan line. The third pixels are electrically connected to the $(4m+3)^{th}$ scan line, and the fourth pixels are electrically connected to the $(4m+4)^{th}$ scan line. The data line is disposed between the first pixels and the second pixels and between the third pixels and the fourth pixels, and is electrically connected to the first pixels, the second pixels, the third pixels and the fourth pixels.

Specifically, when m=1, the first pixel 111 and the second pixel 112 are disposed between the first scan line G1 and the second scan line G2; the first pixel 111 is electrically connected to the first scan line G1; the second pixel 112 is electrically connected to the second scan line G2; the third pixel 113 and the fourth pixel 114 are disposed between the third scan line G3 and the fourth scan line G4; the third pixel 113 is electrically connected to the third scan line G3; the fourth pixel 114 is electrically connected to the fourth scan line G4; and the data line D1 is disposed between the first pixel 111 and the second pixel 112 and between the third pixel 113 and the fourth pixel 114, and is electrically connected to the first pixel 111, the second pixel 112, the third pixel 113 and the fourth pixel 114 respectively.

Similarly, when m=2, the first pixel 115 and the second pixel 116 are disposed between the fifth scan line G5 and the sixth scan line G6; the first pixel 115 is electrically connected to the fifth scan line G5; the second pixel 116 is electrically connected to the sixth scan line G6; the third pixel 117 and the fourth pixel 118 are disposed between the seventh scan line G7 and the eighth scan line G8; the third pixel 117 is electrically connected to the seventh scan line G7; the fourth pixel 118 is electrically connected to the eighth scan line G8; and the data line D1 is disposed between the first pixel 115 and the second pixel 116 and between the third pixel 117 and the fourth pixel 118, and is electrically connected to the first pixel 115, the second pixel 116, the third pixel 117 and the fourth pixel 118 respectively. For other values of m, arrangement and connection relationships between the other pixels and the scan lines and the data lines can be derived in a similar way, and thus will not be further described herein.

Before how the LCD apparatus 1 of the present invention drives the pixels of the pixel array 11 is described, the driving principle of the LCD apparatus will be briefly described to facilitate understanding of the core technology of the present invention. Generally, each of the pixels in the pixel array is electrically connected to a scan line and a data line via a transistor. The scan line is connected to a gate of the transistor to control an on/off status of the transistor, and the data line and the pixel are connected to a drain and a source of the transistor respectively. The data line is used to, when the transistor is turned on (i.e., when the pixel is activated), supply a data signal to the pixel so that the pixel can present a luminance level in response to the data signal.

In the prior art, when a pixel array in an LCD apparatus is driven in a dot inversion driving mode, the LCD apparatus supplies a driving voltage to a plurality of scan lines sequentially to activate pixels in the pixel array sequentially, and the data line supplies a data signal to the activated pixels correspondingly. To accomplish the dot inversion driving mode, the polarity of the data signal must be continuously switched at a high frequency from a positive polarity to a negative polarity or vice versa. As a consequence, much energy will be consumed to cause a large power loss.

In the LCD apparatus 1 of the present invention, by changing the order of activation of the pixels in the pixel array, the polarity of the data signal can be switched at a switching frequency in the column inversion driving mode. In this way, the LCD apparatus 1 of the present invention can not only have the frame presentation effect of the dot inversion driving mode, but also have the power-saving advantage of the column inversion driving mode. Hereinbelow, how the pixels in the pixel array 11 are driven by the LCD apparatus 1 of the present invention will be detailed.

Referring to FIG. 1, the scan driving circuit 13 is electrically connected to the $(4m+1)^{th}$ scan line, the $(4m+2)^{th}$ scan line, the $(4m+3)^{th}$ scan line and the $(4m+4)^{th}$ scan line respectively. The scan driving circuit 13 is configured to supply a driving voltage to the scan lines to activate the pixels in the pixel array 11. In this embodiment, the transistor coupling a pixel to a scan line is an N-type transistor, so the driving voltage is a positive voltage. In other embodiments, the transistor coupling a pixel to a scan line may also be a P-type transistor, in which the driving voltage is a negative voltage.

In the first embodiment, the LCD apparatus 1 activates the pixels in the pixel array 11 in a first order. Hereinbelow, how the scan driving circuit 13 supplies a driving signal to individual scan lines in the first order will be detailed. The scan driving circuit 13 firstly supplies a driving signal to the $(4m+1)^{th}$ scan line and the $(4m+4)^{th}$ scan line in an ascending order of the value of m to activate the first pixels and the fourth pixels, and then supplies the driving signal to the $(4m+2)^{th}$ scan line and the $(4m+3)^{th}$ scan line in an ascending order of the value of m to activate the second pixels and the third pixels.

In particular, the scan driving circuit 13 supplies the driving signal to the first scan line G1, the fourth scan line G4, the fifth scan line G5, the eighth scan line G8, . . . , the $1117^{th}$ scan line and the $1120^{th}$ scan line sequentially to activate the first pixel 111, the fourth pixel 114, the first pixel 115, the fourth pixel 118, . . . , and the first pixel electrically connected to the $1117^{th}$ scan line and the fourth pixel electrically connected to the $1120^{th}$ scan line respectively. Then, the scan driving circuit 13 supplies the driving signal to the second scan line G2, the third scan line G3, the sixth scan line G6, the seventh scan line G7, . . . , the $1118^{th}$ scan line G1118 and the $1119^{th}$ scan line G1119 sequentially to activate the second pixel 112, the third pixel 113, the second pixel 116, the third pixel 117, . . . , the second pixel electrically connected to the $1118^{th}$ scan line G1118 and the third pixel electrically connected to the $1119^{th}$ scan line G1119 respectively.

The data driving circuit 12 is electrically connected to the data line D1. The data driving circuit 12 is configured to supply a first polarity data signal to the data line D1 to enable the first pixels and the fourth pixels to present a first polarity when the first pixels and the fourth pixels are activated, and supply a second polarity data signal to the data line D1 to enable the second pixels and the third pixels to present a second polarity when the second pixels and the third pixels are activated.

Specifically, when the first pixel 111, the fourth pixel 114, the first pixel 115, the fourth pixel 118, . . . , and the other first pixels and fourth pixels are activated, the data driving circuit 12 supplies the first polarity data signal (e.g., a positive voltage data signal) to the data line D1, and then the first pixel 111, the fourth pixel 114, the first pixel 115, the fourth pixel 118, . . . , and the other first pixels and fourth pixels present a positive polarity. Next, when the second pixel 112, the third pixel 113, the second pixel 116, the third pixel 117, . . . , and the other second pixels and third pixels are activated, the data driving circuit 12 supplies the second polarity data signal (e.g., a negative voltage data signal) to the data line D1, and then the second pixel 112, the third pixel 113, the second pixel 116, the third pixel 117, . . . , and the other second pixels and third pixels present a negative polarity. In this way, the pixel array 11 can present a frame in the dot inversion driving mode, i.e., any two adjacent pixels have opposite polarities, as shown in FIG. 1.

Figure 2A:
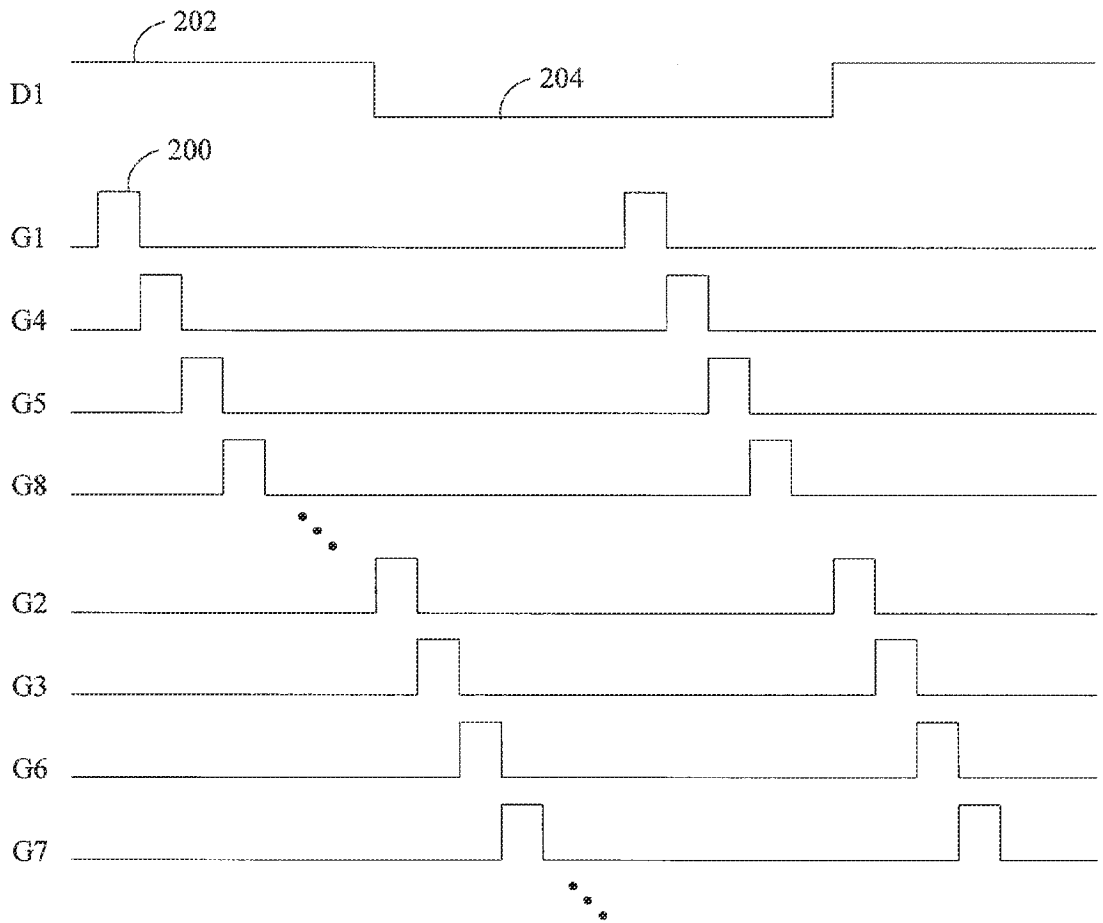
FIG. 2A is a schematic view illustrating timing sequences of signals according to the first embodiment of the present invention.

Referring to FIG. 2A, there is shown a schematic view of time sequences of signals according to the first embodiment of the present invention, wherein the horizontal axis represents the time and the vertical axis represents the voltage. As shown, in a time period in which the driving signal 200 (i.e., the positive voltage signal) is supplied to the first scan line G1, the fourth scan line G4, the fifth scan line G5, the eighth scan line G8, . . . , the $1117^{th}$ scan line and the $1120^{th}$ scan line sequentially, the data line D1 supplies the positive voltage data signal 202 continuously; and it is not until a time period in which the driving signal 200 is supplied to the second scan line G2, the third scan line G3, the sixth scan line G6, the seventh scan line G7, . . . , the $1118^{th}$ scan line G1118 and the $1119^{th}$ scan line G1119 sequentially that the data line D1 switches the data signal into the negative voltage data signal 204. Accordingly, by changing the order of activation of the pixels in the pixel array 11, the LCD apparatus 1 of the present invention extends the time periods in which the data line D1 supplies the positive voltage data signal 202 and the negative voltage data signal 204 respectively. This can remarkably reduce the frequency of switching the data signal between the positive polarity and the negative polarity, thereby obtaining the advantage of reducing the power loss.

To accomplish the pixel activation order of the first embodiment, the scan driving circuit must supply the driving signal to the scan lines sequentially in the aforesaid order. Hereinbelow, how the scan driving circuit supplies the driving signal will be detailed. The scan driving circuit of this embodiment comprises a first stage shift register to an $N^{th}$ stage shift register, each of which is electrically connected to a next stage shift register to transmit the driving signal. Output terminals of the first stage shift register to the $(N/2)^{th}$ stage shift register are sequentially electrically connected to the $(4m+1)^{th}$ scan line and the $(4m+4)^{th}$ scan line in an ascending order of the value of m, and output terminals of the $(N/2+1)^{th}$ stage shift register to the $N^{th}$ stage shift register are sequentially electrically connected to the $(4m+2)^{th}$ scan line and the $(4m+3)^{th}$ scan line in an ascending order of the value of m. The first stage shift register is configured to receive the driving signal and sequentially transmit the driving signal to the $N^{th}$ stage shift register so as to sequentially supply the driving signal to the $(4m+1)^{th}$ scan line and the $(4m+4)^{th}$ scan line in an ascending order of the value of m and then sequentially supply the driving signal to the $(4m+2)^{th}$ scan line and the $(4m+3)^{th}$ scan line in an ascending order of the value of m.

Figure 3A:
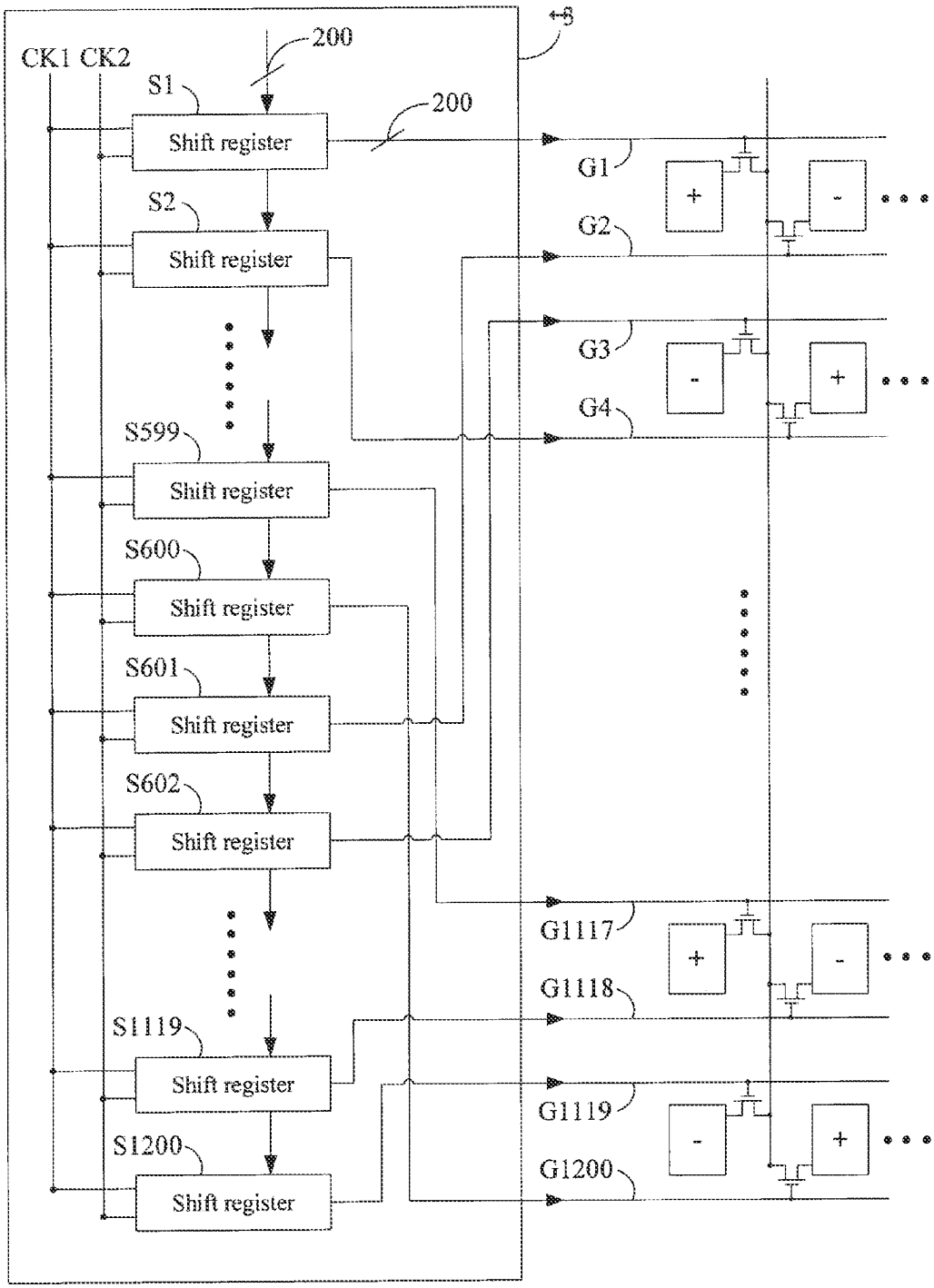
FIG. 3A is a schematic view of a scan driving circuit according to the first embodiment of the present invention.

Specifically, referring to FIG. 3A, there is shown a schematic view of the scan driving circuit according to the first embodiment of the present invention. In this embodiment, the scan driving circuit 13 comprises a first stage shift register S1 to a $1200^{th}$ stage shift register S1200, each of which is electrically connected to a next stage shift register; i.e., the first stage shift register S1 is electrically connected to the second stage shift register S2, the second stage shift register S2 is electrically connected to the third stage shift register S3, . . . , and the $1119^{th}$ stage shift register S1119 is electrically connected to the $1200^{th}$ stage shift register S1200. An output terminal of the first stage shift register S1 is electrically connected to the first scan line G1, an output terminal of the second stage shift register S2 is electrically connected to the fourth scan line G4, . . . , an output terminal of the $599^{th}$ stage shift register S599 is electrically connected to the $1117^{th}$ scan line G1117, and an output terminal of the $600^{th}$ stage shift register S600 is electrically connected to the $1200^{th}$ scan line G1200. An output terminal of the $601^{st}$ stage shift register S601 is electrically connected to the second scan line G2, an output terminal of the $602^{nd}$ stage shift register S602 is electrically connected to the third scan line G3, . . . , an output terminal of the $1119^{th}$ stage shift register S1119 is electrically connected to the $1118^{th}$ scan line G1118, and an output terminal of the $1200^{th}$ stage shift register S1200 is electrically connected to the $1119^{th}$ scan line G1119.

The first stage shift register S1 receives the driving signal 200, outputs the driving signal 200 to the first scan line G1, and transmits the driving signal 200 to the second stage shift register S2; the second stage shift register S2 receives the driving signal 200, outputs the driving signal 200 to the fourth scan line G4, and transmits the driving signal 200 to the third stage shift register S3; . . . ; the $1119^{th}$ stage shift register S1119 receives the driving signal 200, outputs the driving signal 200 to the $1118^{th}$ scan line G1118, and transmits the driving signal 200 to the $1200^{th}$ stage shift register S1200; and finally, the $1200^{th}$ stage shift register S1200 receives the driving signal 200, and outputs the driving signal 200 to the $1119^{th}$ scan line G1119.

In brief, a plurality of shift registers in the scan driving circuit are electrically connected in sequence and transmit the driving signal in sequence, and by changing the way in which the output terminals of the shift registers are connected to the scan lines, the scan driving circuit can activate the pixels of the pixel array in the first order. It shall be particularly appreciated that, in this embodiment, the aforesaid connections are implemented inside the scan driving circuit as shown in FIG. 3A; however, in other embodiments, the aforesaid connections may also be implemented outside the scan driving circuit, i.e., implemented between the plurality of output terminals of the scan driving circuit and the plurality of scan lines, and this is not intended to limit the scope of the present invention.

Apart from activating the pixels of the pixel array 11 in the first order as described in the first embodiment, the LCD apparatus 1 of the present invention may also activate the pixels of the pixel array 11 in a second order as described in a second embodiment. Hereinbelow, how the scan driving circuit supplies the driving signal to the scan lines in the second order will be detailed. The second embodiment differs from the first embodiment in the order in which the scan driving circuit supplies the driving signal to the individual scan lines; and in more detail, in the second embodiment, the scan driving circuit firstly supplies a driving signal to the $(4m+1)^{th}$ scan line and the $(4m+4)^{th}$ scan line in an ascending order of the value of m to activate the first pixels and the fourth pixels, and then supplies the drive signal to the $(4m+3)^{th}$ scan line and the $(4m+2)^{th}$ scan line in a descending order of the value of m to activate the second pixels and the third pixels.

Figure 3B:
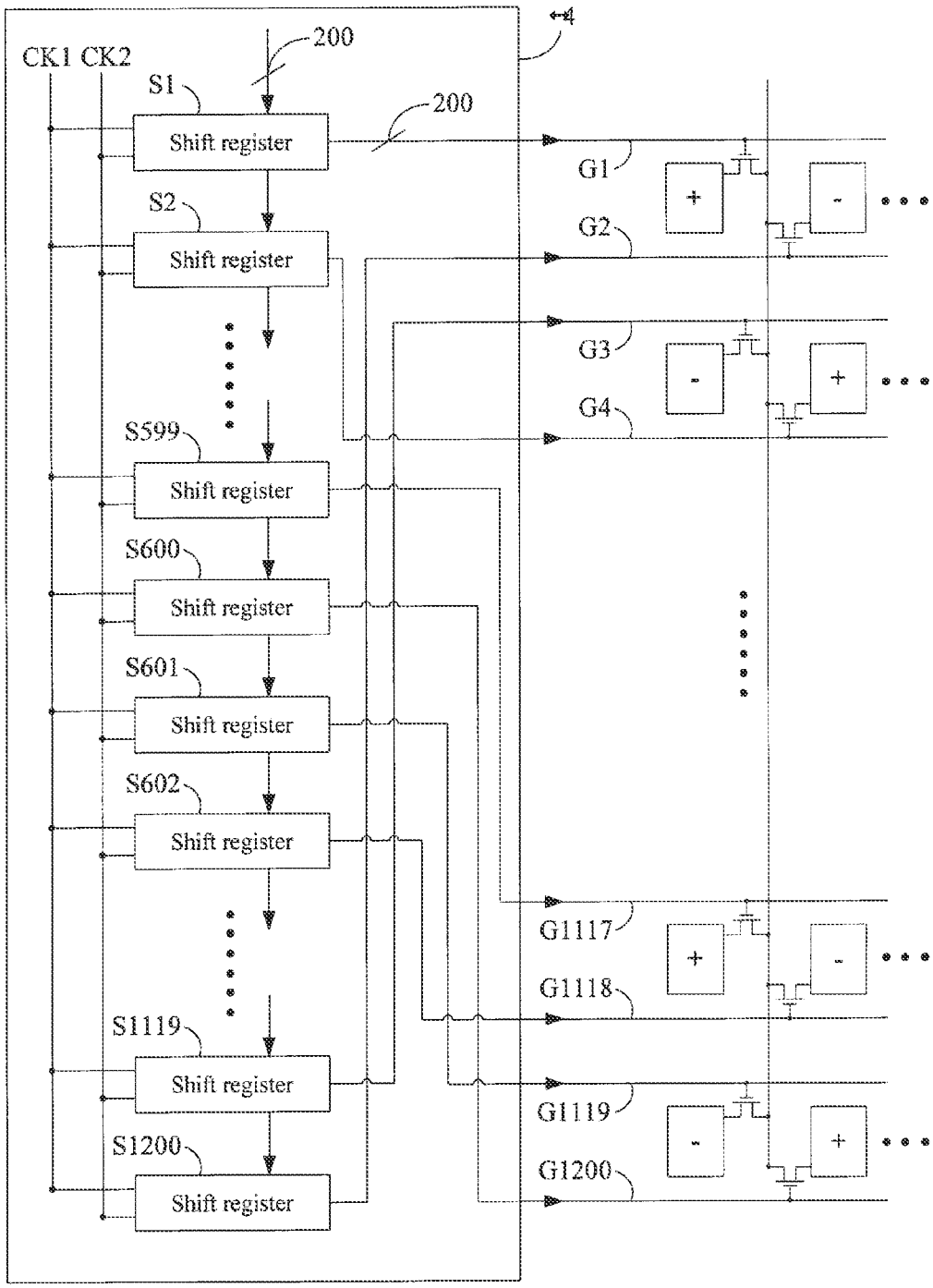
FIG. 3B is a schematic view of a scan driving circuit according to the second embodiment of the present invention.

Specifically, referring to FIG. 3B, there is shown a schematic view of a scan driving circuit according to the second embodiment of the present invention. In this embodiment, the scan driving circuit 14 sequentially supplies the driving signal to the first scan line G1, the fourth scan line G4, the fifth scan line G5, the eighth scan line G8, . . . , the $1117^{th}$ scan line and the $1120^{th}$ scan line to activate the first pixel 111, the fourth pixel 114, the first pixel 115, the fourth pixel 118, . . . , and the other first pixels and fourth pixels electrically connected to the aforesaid scan lines respectively. Then, the scan driving circuit 14 sequentially supplies the driving signal to the $1119^{th}$ scan line G1119, the $1118^{th}$ scan line G1118, the $1115^{th}$ scan line G1115, the $1114^{th}$ scan line G1114, . . . , the third scan line G3 and the second scan line G2 to activate the second pixels and the third pixels electrically connected to the aforesaid scan lines respectively.

Figure 2B:
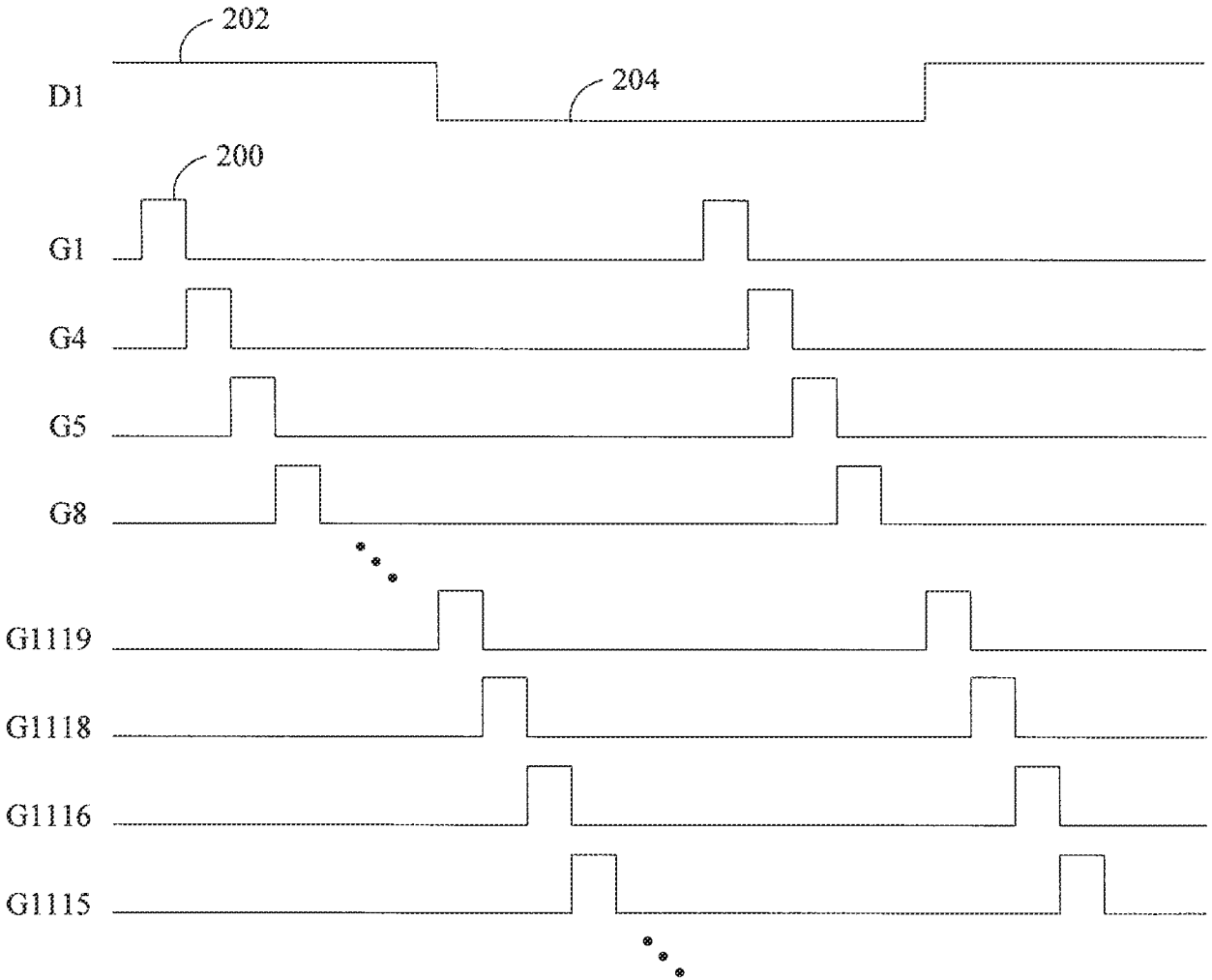
FIG. 2B is a schematic view illustrating timing sequences of signals according to a second embodiment of the present invention.

Referring to FIG. 2B, there is shown a schematic view of time sequences of signals according to the second embodiment of the present invention, wherein the horizontal axis represents the time and the vertical axis represents the voltage. As shown, in a time period in which the driving signal 200 (i.e., the positive voltage signal) is supplied to the first scan line G1, the fourth scan line G4, the fifth scan line G5, the eighth scan line G8, . . . , the $1117^{th}$ scan line and the $1120^{th}$ scan line sequentially, the data line D1 supplies the positive voltage data signal 202 continuously; and it is not until a time period in which the driving signal 200 is supplied to the $1119^{th}$ scan line G1119, the $1118^{th}$ scan line G1118, the $1116^{th}$ scan line G1116, the $1115^{th}$ scan line G1115, . . . , the third scan line G3 and the second scan line G2 sequentially that the data line D1 switches the data signal into the negative voltage data signal 204.

In order to accomplish the pixel activation order of the second embodiment, the scan driving circuit 14 is also connected in a different way. Specifically, the scan driving circuit 14 differs from the scan driving circuit 13 of the first embodiment in that: an output terminal of the $601^{st}$ stage shift register S601 is electrically connected to the $1119^{th}$ scan line G1119, an output terminal of the $602^{nd}$ stage shift register S602 is electrically connected to the $1118^{th}$ scan line G1118, . . . , an output terminal of the $1119^{th}$ stage shift register S1119 is electrically connected to the third scan line G3, and an output terminal of the $1200^{th}$ stage shift register S1200 is electrically connected to the second scan line G2.

In addition to the aforesaid differences, the second embodiment can also execute all the operations and functions set forth in the first embodiment. The differences between the second embodiment and the first embodiment as well as how the second embodiment executes these operations and functions on the basis of the first embodiment will be readily appreciated by those of ordinary skill in the art, and thus will not be further described herein.

Apart from the framework as described in the first embodiment, the scan driving circuit may also adopt other frameworks to accomplish the pixel activation order described in the first embodiment. Hereinbelow, how a scan driving circuit of a third embodiment of the present invention supplies the driving signal in the first order will be detailed. The scan driving circuit of the third embodiment comprises a first transmission path and a second transmission path. The first transmission path is configured to receive and transmit the driving signal, and comprises: a $(4p+1)^{th}$ stage shift register, comprising an input terminal configured to receive the driving signal and an output terminal electrically connected to the $(4p+1)^{th}$ scan line; a $(4p+4)^{th}$ stage shift register, comprising an input terminal electrically connected to the output terminal of the $(4p+1)^{th}$ stage shift register and an output terminal electrically connected to the $(4p+4)^{th}$ scan line; a $(4p+5)^{th}$ stage shift register, comprising an input terminal electrically connected to the output terminal of the $(4p+4)^{th}$ stage shift register and an output terminal electrically connected to the $(4p+5)^{th}$ scan line; and a $(4p+8)^{th}$ stage shift register, comprising an input terminal electrically connected to the output terminal of the $(4p+5)^{th}$ stage shift register and an output terminal electrically connected to the $(4p+8)^{th}$ scan line.

The second transmission path is connected to the first transmission path and configured to transmit the driving signal. The second transmission path comprises: a $(4p+2)^{th}$ stage shift register, comprising an input terminal configured to receive the driving signal and an output terminal electrically connected to the $(4\ p+2)^{th}$ scan line; a $(4p+3)^{th}$ stage shift register, comprising an input terminal electrically connected to the output terminal of the $(4p+2)^{th}$ stage shift register and an output terminal electrically connected to the $(4p+3)^{th}$ scan line; a $(4\ p+6)^{th}$ stage shift register, comprising an input terminal electrically connected to the output terminal of the $(4p+3)^{th}$ stage shift register and an output terminal electrically connected to the $(4p+6)^{th}$ scan line; and a $(4p+7)^{th}$ stage shift register, comprising an input terminal electrically connected to the output terminal of the $(4p+6)^{th}$ stage shift register and an output terminal electrically connected to the $(4\ p+7)^{th}$ scan line.

The driving signal is sequentially transmitted to the $(4p+1)^{th}$ scan line, the $(4p+4)^{th}$ scan line, the $(4p+5)^{th}$ scan line and the $(4p+8)^{th}$ scan line in an ascending order of a value of p via the first transmission path and sequentially transmitted to the $(4p+2)^{th}$ scan line, the $(4p+3)^{th}$ scan line, the $(4p+6)^{th}$ scan line and the $(4p+7)^{th}$ scan line in an ascending order of the value of p via the second transmission path, wherein p includes even integers ranging from 0 to N/4−2. In this embodiment, N=1200, and p is an even integer ranging from 0 to 298 (i.e., 0, 2, 4, . . . , 296 and 298). For example, if p=0, then the $(4p+1)^{th}$ scan line is the first scan line, and the $(4p+8)^{th}$ scan line is the eighth scan line; if p=2, then the $(4p+1)^{th}$ scan line is the ninth scan line; if p=298, then the $(4p+8)^{th}$ scan line is the $1200^{th}$ scan line; and so on.

Figure 4A:
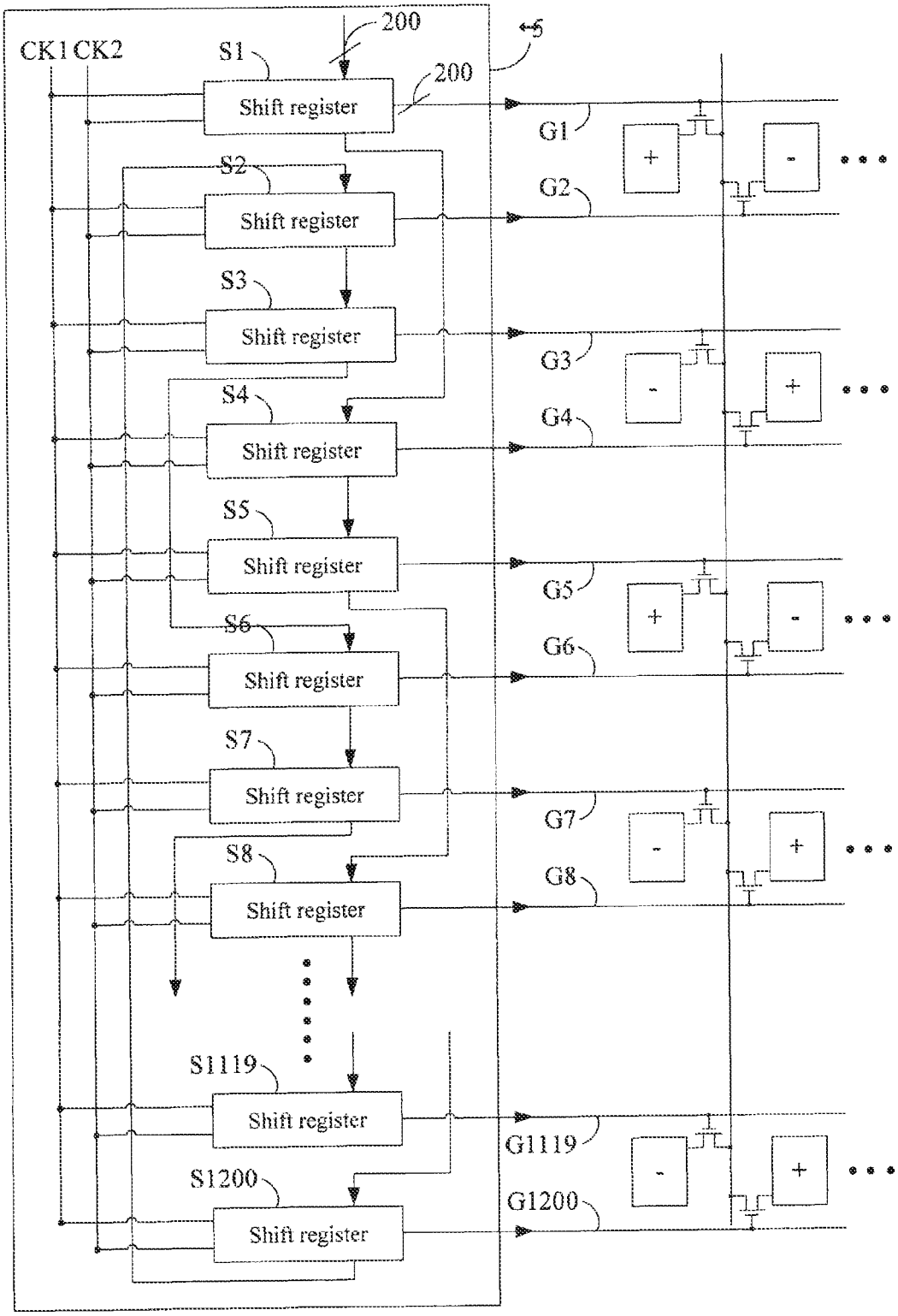
FIG. 4A is a schematic view of a scan driving circuit according to a third embodiment of the present invention.

Specifically, referring to FIG. 4A, there is shown a schematic view of the scan driving circuit according to the third embodiment of the present invention. In this embodiment, the scan driving circuit 15 comprises a first stage shift register S1 to a $1200^{th}$ stage shift register S1200. An output terminal of the first stage shift register S1 is electrically connected to the first scan line G1; an output terminal of the second stage shift register S2 is electrically connected to the second scan line G2; an output terminal of the third stage shift register S3 is electrically connected to the third scan line G3; an output terminal of the fourth stage shift register S4 is electrically connected to the fourth scan line G4; . . . ; an output terminal of the $1119^{th}$ stage shift register S1119 is electrically connected to the $1119^{th}$ scan line G1119; and an output terminal of the $1200^{th}$ stage shift register S1200 is electrically connected to the $1200^{th}$ scan line G1200.

Different from the scan driving circuit 13 of the first embodiment, the scan driving circuit 15 of this embodiment accomplishes the aforesaid pixel activation order by changing connections between individual shift registers, with the output terminals of the individual shift registers being electrically connected to the corresponding scan lines respectively. Hereinbelow, connections between the individual shift registers in the scan driving circuit 15 will be described. As shown in FIG. 4A, the first transmission path comprises: a first stage shift register S1 having an input terminal configured to receive the driving signal 200; a fourth stage shift register S4 having an input terminal electrically connected to an output terminal of the first stage shift register 51; a fifth stage shift register S5 having an input terminal electrically connected to an output terminal of the fourth stage shift register S4; an eighth stage shift register S8 having an input terminal electrically connected to an output terminal of the fifth stage shift register S5; . . . ; and a $1200^{th}$ stage shift register S1200 having an input terminal electrically connected to an output terminal of the $1117^{th}$ stage shift register S1117.

Then, the second transmission path is connected to the first transmission path. The second transmission path comprises: a second stage shift register S2 having an input terminal electrically connected to an output terminal of the $1200^{th}$ stage shift register S1200; a third stage shift register S3 having an input terminal electrically connected to an output terminal of the second stage shift register S2; a sixth stage shift register S6 having an input terminal electrically connected to an output terminal of the third stage shift register S3; a seventh stage shift register S7 having an input terminal electrically connected to an output terminal of the sixth stage shift register S6; . . . ; and a $1119^{th}$ stage shift register S1119 having an input terminal electrically connected to an output terminal of the $1118^{th}$ stage shift register S1118.

Through the connections between the individual shift registers described above, the driving signal 200 can be outputted to individual scan lines via the first transmission path and the second transmission path in the following way: the first stage shift register S1 receives the driving signal 200 at the input terminal thereof, outputs the driving signal 200 to the first scan line G1, and transmits the driving signal 200 to the fourth stage shift register S4; the fourth stage shift register S4 receives the driving signal 200 from the first stage shift register S1, outputs the driving signal 200 to the fourth scan line G4, and transmits the driving signal 200 to the fifth stage shift register S5; the fifth stage shift register S5 receives the driving signal 200 from the fourth stage shift register S4, outputs the driving signal 200 to the fifth scan line G5, and transmits the driving signal 200 to the eighth stage shift register S8; . . . ; the $1200^{th}$ stage shift register S1200 receives the driving signal 200 from the $1117^{th}$ stage shift register S1117, outputs the driving signal 200 to the $1200^{th}$ scan line G1200, and transmits the driving signal 200 to the second stage shift register S2; the second stage shift register S2 receives the driving signal 200 from the $1200^{th}$ stage shift register S1200, outputs the driving signal 200 to the second scan line G2, and transmits the driving signal 200 to the third stage shift register S3; the third stage shift register S3 receives the driving signal 200 from the second stage shift register S2, outputs the driving signal 200 to the third scan line G3, and transmits the driving signal 200 to the sixth stage shift register S6; . . . ; and finally, the $1119^{th}$ stage shift register S1119 receives the driving signal 200 from the $1118^{th}$ stage shift register S1118, and outputs the driving signal 200 to the $1118^{th}$ scan line G1118.

The scan driving circuit may also accomplish the pixel activation order described in the second embodiment by adopting the framework described in the third embodiment. Hereinbelow, how a scan driving circuit of a fourth embodiment of the present invention supplies the driving signal according to the second order will be detailed. The scan driving circuit of the fourth embodiment comprises a first transmission path and a second transmission path. The first transmission path is configured to receive and transmit the driving signal, and comprises: a $(4p+1)^{th}$ stage shift register, comprising an input terminal configured to receive the driving signal and an output terminal electrically connected to the $(4p+1)^{th}$ scan line; a $(4p+4)^{th}$ stage shift register, comprising an input terminal electrically connected to the output terminal of the $(4p+1)^{th}$ stage shift register and an output terminal electrically connected to the $(4p+4)^{th}$ scan line; a $(4p+5)^{th}$ stage shift register, comprising an input terminal electrically connected to the output terminal of the $(4p+4)^{th}$ stage shift register and an output terminal electrically connected to the $(4p+5)^{th}$ scan line; and a $(4p+8)^{th}$ stage shift register, comprising an input terminal electrically connected to the output terminal of the $(4p+5)^{th}$ stage shift register and an output terminal electrically connected to the $(4\ p+8)^{th}$ scan line.

The second transmission path is connected to the first transmission path and configured to transmit the driving signal. The second transmission path comprises: a $(4p+7)^{th}$ stage shift register, comprising an input terminal configured to receive the driving signal and an output terminal electrically connected to the $(4p+7)^{th}$ scan line; a $(4\ p+6)^{th}$ stage shift register, comprising an input terminal electrically connected to the output terminal of the $(4p+7)^{th}$ stage shift register and an output terminal electrically connected to the $(4p+6)^{th}$ scan line; a $(4p+3)^{th}$ stage shift register, comprising an input terminal electrically connected to the output terminal of the $(4p+6)^{th}$ stage shift register and an output terminal electrically connected to the $(4p+3)^{th}$ scan line; and a $(4p+2)^{th}$ stage shift register, comprising an input terminal electrically connected to the output terminal of the $(4p+3)^{th}$ stage shift register and an output terminal electrically connected to the $(4p+2)^{th}$ scan line.

The driving signal is sequentially transmitted to the $(4p+1)^{th}$ scan line, the $(4p+4)^{th}$ scan line, the $(4p+5)^{th}$ scan line and the $(4p+8)^{th}$ scan line in an ascending order of the value of p via the first transmission path and sequentially transmitted to the $(4p+7)^{th}$ scan line, the $(4p+6)^{th}$ scan line, the $(4p+3)^{th}$ scan line and the $(4\ p+2)^{th}$ scan line in a descending order of the value of p via the second transmission path, wherein p includes even integers ranging from 0 to N/4−2. In this embodiment, N=1200, and p includes even integers ranging from 0 to 298 (i.e., 0, 2, 4, . . . , 296, and 298).

Figure 4B:
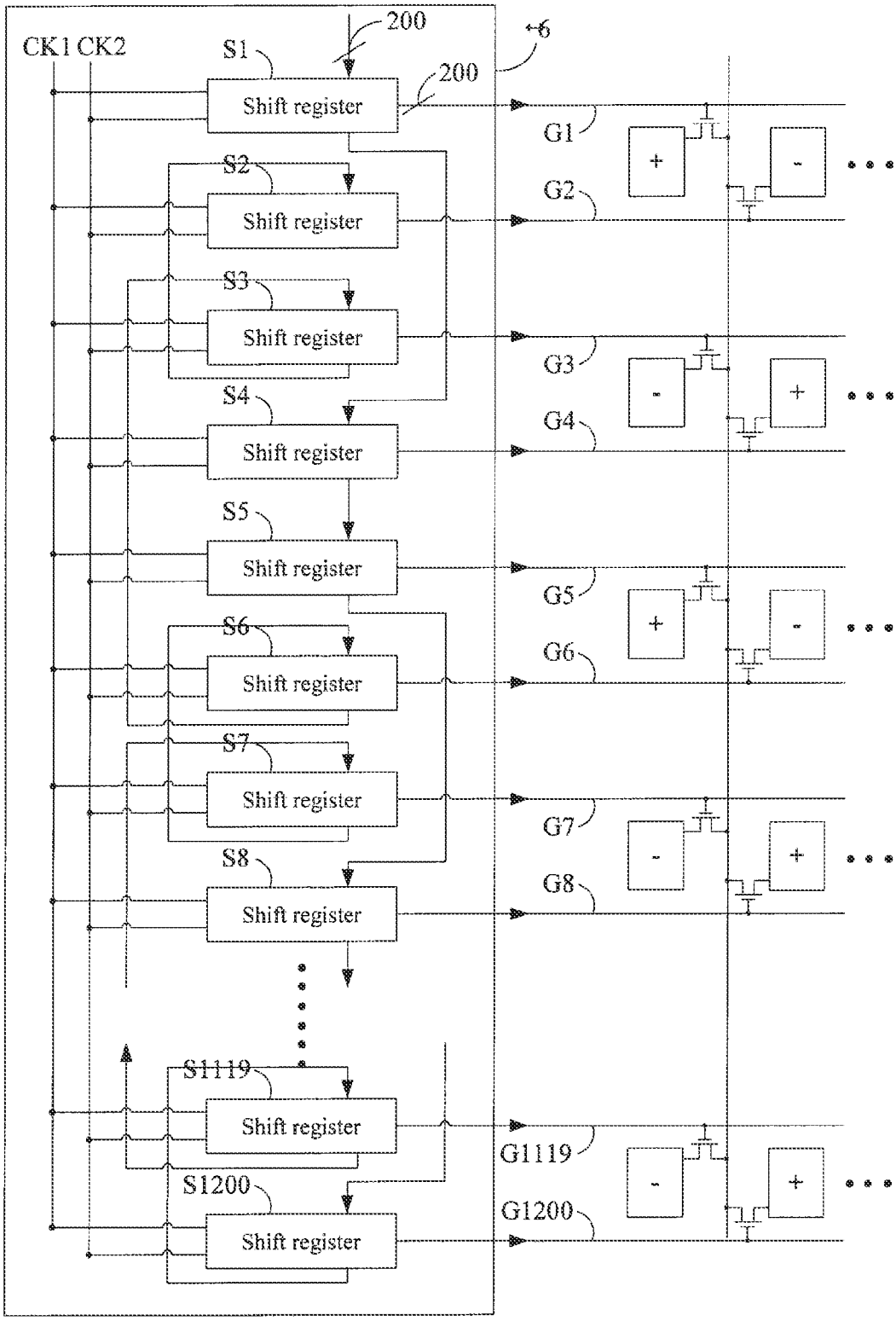
FIG. 4B is a schematic view of a scan driving circuit according to a fourth embodiment of the present invention.

Referring to FIG. 4B, there is shown a schematic view of the scan driving circuit according to the fourth embodiment of the present invention. The difference between the scan driving circuit 16 of the fourth embodiment and the scan driving circuit 15 of the third embodiment is second transmission path. The second transmission path of the scan driving circuit 16 comprises: a $1119^{th}$ stage shift register S1119 having an input terminal electrically connected to an output terminal of the $1200^{th}$ stage shift register S1200; a $1118^{th}$ stage shift register S1118 having an input terminal electrically connected to an output terminal of the $1119^{th}$ stage shift register S1119; . . . ; a sixth stage shift register S6 having an input terminal electrically connected to an output terminal of the seventh stage shift register S7; a third stage shift register S3 having an input terminal electrically connected to an output terminal of the sixth stage shift register S6; and a second stage shift register S2 having an input terminal electrically connected to an output terminal of the third stage shift register S3.

Through the connections between the individual shift registers in the fourth embodiment described above, the driving signal 200 can be outputted to individual scan lines via the first transmission path and the second transmission path in the following way: the first stage shift register S1 receives the driving signal 200 at the input terminal thereof, outputs the driving signal 200 to the first scan line G1, and transmits the driving signal 200 to the fourth stage shift register S4; the fourth stage shift register S4 receives the driving signal 200 from the first stage shift register S1, outputs the driving signal 200 to the fourth scan line G4, and transmits the driving signal 200 to the fifth stage shift register S5; the fifth stage shift register S5 receives the driving signal 200 from the fourth stage shift register S4, outputs the driving signal 200 to the fifth scan line G5, and transmits the driving signal 200 to the eighth stage shift register S8; . . . ; the $1200^{th}$ stage shift register S1200 receives the driving signal 200 from the $1117^{th}$ stage shift register S1117, outputs the driving signal 200 to the $1200^{th}$ scan line G1200, and transmits the driving signal 200 to the $1119^{th}$ stage shift register S1119; the $1119^{th}$ stage shift register S1119 receives the driving signal 200 from the $1200^{th}$ stage shift register S1200, outputs the driving signal 200 to the $1119^{th}$ scan line G1119, and transmits the driving signal 200 to the $1118^{th}$ stage shift register S1118; the $1118^{th}$ stage shift register S1118 receives the driving signal 200 from the $1119^{th}$ stage shift register S1119, outputs the driving signal 200 to the $1118^{th}$ scan line G1118, and transmits the driving signal 200 to the $1115^{th}$ stage shift register S1115; . . . ; and finally, the second stage shift register S2 receives the driving signal 200 from the third stage shift register S3, and outputs the driving signal 200 to the second scan line G2.

Furthermore, the present invention further has a fifth embodiment. In the fifth embodiment, the LCD apparatus comprises a pixel array, a first scan driving circuit, a second scan driving circuit and a data driving circuit. The pixel array has a circuit structure which is the same as that of the pixel array 11 described in the first embodiment. The first scan driving circuit is configured to sequentially supply a driving signal to the $(4m+1)^{th}$ scan line and the $(4m+4)^{th}$ scan line in an ascending order of the value of m to activate the first pixels and the fourth pixels, and the second scan driving circuit is configured to sequentially supply the driving signal to the $(4m+2)^{th}$ scan line and the $(4m+3)^{th}$ scan line in an ascending or descending order of the value of m to activate the second pixels and the third pixels.

The fifth embodiment differs from the first embodiment in that, the fifth embodiment uses two scan driving circuits to control activation of pixels intended to have the first polarity and pixels intended to have the second polarity respectively. The first scan driving circuit sequentially supplies the driving voltage to the first pixels and the fourth pixels and the second scan driving circuit sequentially supplies the driving voltage to the second pixels and the third pixels so that the pixels in the pixel array are activated in the first order or the second order described above.

In addition to the aforesaid differences, the fifth embodiment can also execute all the operations and functions set forth in the first embodiment. The differences between the fifth embodiment and the first embodiment as well as how the fifth embodiment executes these operations and functions on the basis of the first embodiment will be readily appreciated by those of ordinary skill in the art, and thus will not be further described herein.

Figure 5:
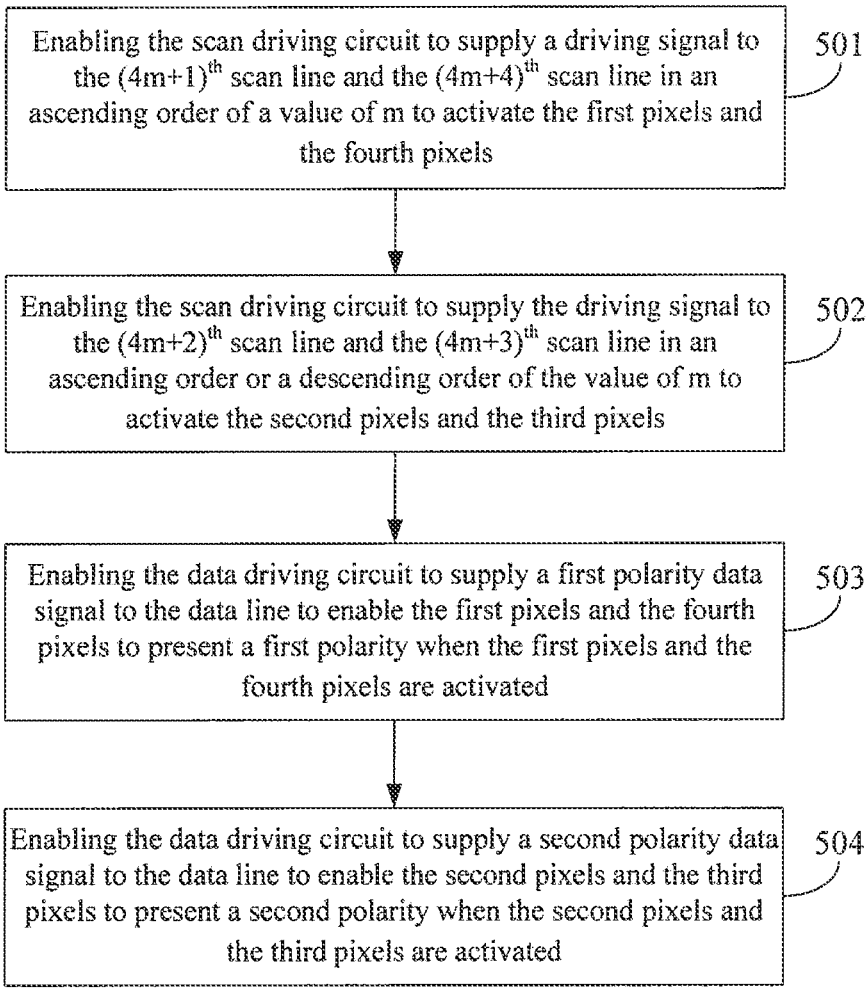
FIG. 5 is a flowchart of a sixth embodiment of the present invention.

FIG. 5 shows a sixth embodiment of the present invention, which is a pixel driving method for use in the LCD apparatus described in the first embodiment. The LCD apparatus comprises a pixel array, a scan driving circuit and a data driving circuit. The pixel array comprises a $(4m+1)^{th}$ scan line, a $(4m+2)^{th}$ scan line, a $(4m+3)^{th}$ scan line, a $(4m+4)^{th}$ scan line, a data line, a plurality of first pixels, a plurality of second pixels, a plurality of third pixels and a plurality of fourth pixels.

The first pixels and the second pixels are disposed between the $(4m+1)^{th}$ scan line and the $(4m+2)^{th}$ scan line, the first pixels are electrically connected to the $(4m+1)^{th}$ scan line, the second pixels are electrically connected to the $(4m+2)^{th}$ scan line, the third pixels and the fourth pixels are disposed between the $(4m+3)^{th}$ scan line and the $(4m+4)^{th}$ scan line, the third pixels are electrically connected to the $(4m+3)^{th}$ scan line, and the fourth pixels are electrically connected to the $(4m+4)^{th}$ scan line. The data line is disposed between the first pixels and the second pixels and between the third pixels and the fourth pixels, and the data line is electrically connected to the first pixels, the second pixels, the third pixels and the fourth pixels.

The scan driving circuit is electrically connected to the $(4m+1)^{th}$ scan line, the $(4m+2)^{th}$ scan line, the $(4m+3)^{th}$ scan line and the $(4m+4)^{th}$ scan line. The data driving circuit is electrically connected to the data line.

FIG. 5 depicts a flowchart of the pixel driving method according to the sixth embodiment. Firstly, step 501 is executed to enable the scan driving circuit to supply a driving signal to the $(4m+1)^{th}$ scan line and the $(4m+4)^{th}$ scan line in an ascending order of a value of m to activate the first pixels and the fourth pixels. Then, step 502 is executed to enable the scan driving circuit to supply the driving signal to the $(4m+2)^{th}$ scan line and the $(4m+3)^{th}$ scan line in an ascending order or a descending order of the value of m to activate the second pixels and the third pixels. Here, the pixel array has an overall scan line amount N, and m includes integers ranging from 0 to N/4−1.

Next, step 503 is executed to enable the data driving circuit to supply a first polarity data signal to the data line to enable the first pixels and the fourth pixels to present a first polarity when the first pixels and the fourth pixels are activated, and step 504 is executed to enable the data driving circuit to supply a second polarity data signal to the data line to enable the second pixels and the third pixels to present a second polarity when the second pixels and the third pixels are activated. The first polarity is opposite to the second polarity.

In this embodiment, the scan driving circuit further comprises a first stage shift register to an $N^{th}$ stage shift register, each of which is electrically connected to a next stage shift register. Output terminals of the first stage shift register to the $(N/2)^{th}$ stage shift register are sequentially electrically connected to the $(4m+1)^{th}$ scan line and the $(4m+4)^{th}$ scan line in an ascending order of the value of m, and output terminals of the $(N/2+1)^{th}$ stage shift register to the $N^{th}$ stage shift register are sequentially electrically connected to the $(4m+2)^{th}$ scan line and the $(4m+3)^{th}$ scan line in an ascending order of the value of m.

The pixel driving method may further execute a step 505 (not shown in FIG. 5) to enable the first stage shift register to receive the driving signal and sequentially transmit the driving signal to the $N^{th}$ stage shift register so as to sequentially supply the driving signal to the $(4m+1)^{th}$ scan line and the $(4m+4)^{th}$ scan line in an ascending order of the value of m and then sequentially supply the driving signal to the $(4m+2)^{th}$ scan line and the $(4m+3)^{th}$ scan line in an ascending order of the value of m.

In another embodiment of the present invention, an output terminal of the $(N/2+1)^{th}$ stage shift register to an output terminal of the $N^{th}$ stage shift register are sequentially electrically connected to the $(4m+3)^{th}$ scan line and the $(4m+2)^{th}$ scan line in a descending order of the value of m.

The pixel driving method may further execute a step 506 (not shown in FIG. 5) to enable the first stage shift register to receive the driving signal and sequentially transmit the driving signal to the $N^{th}$ stage shift register so as to sequentially supply the driving signal to the $(4m+1)^{th}$ scan line and the $(4m+4)^{th}$ scan line in an ascending order of the value of m and then sequentially supply the driving signal to the $(4m+3)^{th}$ scan line and the $(4m+2)^{th}$ scan line in a descending order of the value of m.

In another embodiment, the scan driving circuit further comprises a first transmission path and a second transmission path. The first transmission path is configured to receive and transmit the driving signal and comprises: a $(4p+1)^{th}$ stage shift register, comprising an input terminal configured to receive the driving signal and an output terminal electrically connected to the $(4p+1)^{th}$ scan line; a $(4p+4)^{th}$ stage shift register, comprising an input terminal electrically connected to the output terminal of the $(4p+1)^{th}$ stage shift register and an output terminal electrically connected to the $(4p+4)^{th}$ scan line; a $(4p+5)^{th}$ stage shift register, comprising an input terminal electrically connected to the output terminal of the $(4p+4)^{th}$ stage shift register and an output terminal electrically connected to the $(4p+5)^{th}$ scan line; and a $(4p+8)^{th}$ stage shift register, comprising an input terminal electrically connected to the output terminal of the $(4p+5)^{th}$ stage shift register and an output terminal electrically connected to the $(4p+8)^{th}$ scan line.

The second transmission path is connected to the first transmission path and configured to transmit the driving signal. The second transmission path comprises: a $(4p+2)^{th}$ stage shift register, comprising an input terminal configured to receive the driving signal and an output terminal electrically connected to the $(4p+2)^{th}$ scan line; a $(4p+3)^{th}$ stage shift register, comprising an input terminal electrically connected to the output terminal of the $(4p+2)^{th}$ stage shift register and an output terminal electrically connected to the $(4p+3)^{th}$ scan line; a $(4p+6)^{th}$ stage shift register, comprising an input terminal electrically connected to the output terminal of the $(4p+3)^{th}$ stage shift register and an output terminal electrically connected to the $(4p+6)^{th}$ scan line; and a $(4p+7)^{th}$ stage shift register, comprising an input terminal electrically connected to the output terminal of the $(4p+6)^{th}$ stage shift register and an output terminal electrically connected to the $(4p+7)^{th}$ scan line.

The pixel driving method may further execute a step 507 (not shown in FIG. 5) which enables the scan driving circuit to transmit the driving signal to the $(4p+1)^{th}$ scan line, the $(4p+4)^{th}$ scan line, the $(4p+5)^{th}$ scan line and the $(4p+8)^{th}$ scan line in an ascending order of a value of p via the first transmission path, and a step 508 (not shown in FIG. 5) which enables the scan driving circuit to transmit the driving signal to the $(4p+2)^{th}$ scan line, the $(4p+3)^{th}$ scan line, the $(4p+6)^{th}$ scan line and the $(4p+7)^{th}$ scan line in an ascending order of the value of p via the second transmission path. Here, p includes even integers ranging from 0 to N/4−2.

In another embodiment, the second transmission path is connected to the first transmission path and configured to transmit the driving signal. The second transmission path comprises: a $(4p+7)^{th}$ stage shift register, comprising an input terminal configured to receive the driving signal and an output terminal electrically connected to the $(4p+7)^{th}$ scan line; a $(4p+6)^{th}$ stage shift register, comprising an input terminal electrically connected to the output terminal of the $(4p+7)^{th}$ stage shift register and an output terminal electrically connected to the $(4p+6)^{th}$ scan line; a $(4p+3)^{th}$ stage shift register, comprising an input terminal electrically connected to the output terminal of the $(4p+6)^{th}$ stage shift register and an output terminal electrically connected to the $(4p+3)^{th}$ scan line; and a $(4p+2)^{th}$ stage shift register, comprising an input terminal electrically connected to the output terminal of the $(4p+3)^{th}$ stage shift register and an output terminal electrically connected to the $(4p+2)^{th}$ scan line.

The pixel driving method may further execute a step 509 (not shown in FIG. 5) which enables the scan driving circuit to transmit the driving signal to the $(4p+7)^{th}$ scan line, the $(4p+6)^{th}$ scan line, the $(4p+3)^{th}$ scan line and the $(4p+2)^{th}$ scan line in a descending order of the value of p via the second transmission path. Here, p includes even integers ranging from 0 to N/4−2.

In addition to the aforesaid steps, the sixth embodiment can also execute all the operations and functions set forth in the first to the fifth embodiments. How the sixth embodiment executes these operations and functions will be readily appreciated by those of ordinary skill in the art based on the explanation of the first to the fifth embodiments, and thus will not be further described herein.

According to the above descriptions, by changing the order of activation of the pixels in the pixel array (i.e., by changing the order in which the scan driving circuit supplies the driving signal to the scan lines) and by having the data driving circuit supply a first polarity data signal and a second polarity data signal to the data lines when the pixels are activated, the present invention allows the pixel array to deliver a frame presentation effect of the dot inversion driving mode; furthermore, it is unnecessary for the data driving circuit to switch between the first polarity data signal and the second polarity data signal at a high frequency. Thereby, the present invention can overcome the disadvantage of the prior art column inversion driving mode that V-line Mura in the vertical direction may occur in the frame, and also have the power-saving advantage of the column inversion driving mode.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A liquid crystal display apparatus comprising:

a pixel array, comprising a $(4m+1)^{th}$ scan line, a $(4m+2)^{th}$ scan line, a $(4m+3)^{th}$ scan line, a $(4m+4)^{th}$ scan line, a plurality of data lines, a plurality of first pixels, a plurality of second pixels, a plurality of third pixels and a plurality of fourth pixels, the first pixels and the second pixels being disposed between the $(4m+1)^{th}$ scan line and the $(4m+2)^{th}$ scan line, the first pixels being electrically connected to the $(4m+1)^{th}$ scan line, the second pixels being electrically connected to the $(4m+2)^{th}$ scan line, the third pixels and the fourth pixels being disposed between the $(4m+3)^{th}$ scan line and the $(4m+4)^{th}$ scan line, the third pixels being electrically connected to the $(4m+3)^{th}$ scan line, the fourth pixels being electrically connected to the $(4m+4)^{th}$ scan line, the data lines being disposed between the first pixels and the second pixels, and between the third pixels and the fourth pixels, and the data lines being electrically connected to the first pixels, the second pixels, the third pixels and the fourth pixels;

a scan driving circuit, being electrically connected to the $(4m+1)^{th}$ scan line, the $(4m+2)^{th}$ scan line, the $(4m+3)^{th}$ scan line and the $(4m+4)^{th}$ scan line, and being configured to supply a driving signal to the $(4m+1)^{th}$ scan line and the $(4m+4)^{th}$ scan line in an ascending order of a value of m to activate the first pixels and the fourth pixels in a frame, and then, after all of the first pixels and the fourth pixels have been activated, sequentially supply the driving signal to the $(4m+2)^{th}$ scan line and the $(4m+3)^{th}$ scan line in an ascending order of the value of m to activate the second pixels and the third pixels in the frame or sequentially supply the driving signal to the $(4m+3)^{th}$ scan line and the $(4m+2)^{th}$ scan line in a descending order of the value of m to activate the third pixels and the second pixels in the frame; and a data driving circuit, being electrically connected to the data lines, and being configured to supply a first polarity data signal to the data lines to enable the first pixels and the fourth pixels to present a first polarity when the first pixels and the fourth pixels are activated, and supply a second polarity data signal to the data lines to enable the second pixels and the third pixels to present a second polarity when the second pixels and the third pixels are activated, wherein the pixel array has an overall scan line amount N, m includes integers ranging from 0 to N/4−1, and the first polarity is opposite to the second polarity.

2. The liquid crystal display apparatus as claimed in claim 1, wherein the scan driving circuit comprises a first stage shift register to an $N^{th}$ stage shift register, each of the shift registers is electrically connected to the next stage shift register to transmit the driving signal, an output terminal of the first stage shift register to an output terminal of the $(N/2)^{th}$ stage shift register are sequentially electrically connected to the $(4m+1)^{th}$ scan line and the $(4m+4)^{th}$ scan line in an ascending order of the value of m, an output terminal of the $(N/2+1)^{th}$ stage shift register to an output terminal of the $N^{th}$ stage shift register are sequentially electrically connected to the $(4m+2)^{th}$ scan line and the $(4m+3)^{th}$ scan line in an ascending order of the value of m, and the first stage shift register is configured to receive the driving signal and sequentially transmit the driving signal to the $N^{th}$ stage shift register so as to sequentially supply the driving signal to the $(4m+1)^{th}$ scan line and the $(4m+4)^{th}$ scan line in an ascending order of the value of m and then sequentially supply the driving signal to the $(4m+2)^{th}$ scan line and the $(4m+3)^{th}$ scan line in an ascending order of the value of m.

3. The liquid crystal display apparatus as claimed in claim 1, wherein the scan driving circuit comprises a first stage shift register to an $N^{th}$ stage shift register, each of the shift registers is electrically connected to the next stage shift register to transmit the driving signal, an output terminal of the first stage shift register to an output terminal of the $(N/2)^{th}$ stage shift register are sequentially electrically connected to the $(4m+1)$ $^{th}$ scan line and the $(4m+4)^{th}$ scan line in an ascending order of the value of m, an output terminal of the $(N/2+1)^{th}$ stage shift register to an output terminal of the $N^{th}$ stage shift register are sequentially electrically connected to the $(4m+3)^{th}$ scan line and the $(4m+2)^{th}$ scan line in a descending order of the value of m, and the first stage shift register is configured to receive the driving signal and sequentially transmit the driving signal to the $N^{th}$ stage shift register so as to sequentially supply the driving signal to the $(4m+1)^{th}$ scan line and the $(4m+4)^{th}$ scan line in an ascending order of the value of m and then sequentially supply the driving signal to the $(4m+3)^{th}$ scan line and the $(4m+2)^{th}$ scan line in a descending order of the value of m.

4. The liquid crystal display apparatus as claimed in claim 1, wherein the scan driving circuit comprises:

a first transmission path, being configured to receive and transmit the driving signal, comprising:

a $(4p+1)^{th}$ stage shift register, comprising an input terminal configured to receive the driving signal and an output terminal electrically connected to the $(4p+1)^{th}$ scan line;

a $(4p+4)^{th}$ stage shift register, comprising an input terminal electrically connected to the output terminal of the $(4p+1)^{th}$ stage shift register and an output terminal electrically connected to the $(4p+4)^{th}$ scan line;

a $(4p+5)^{th}$ stage shift register, comprising an input terminal electrically connected to the output terminal of the $(4p+4)^{th}$ stage shift register and an output terminal electrically connected to the $(4p+5)^{th}$ scan line; and a $(4p+8)^{th}$ stage shift register, comprising an input terminal electrically connected to the output terminal of the $(4p+5)^{th}$ stage shift register and an output terminal electrically connected to the $(4p+8)^{th}$ scan line; and a second transmission path, being connected to the first transmission path and being configured to transmit the driving signal, comprising:

a $(4p+2)^{th}$ stage shift register, comprising an input terminal configured to receive the driving signal and an output terminal electrically connected to the $(4p+2)^{th}$ scan line;

a $(4p+3)^{th}$ stage shift register, comprising an input terminal electrically connected to the output terminal of the $(4p+2)^{th}$ stage shift register and an output terminal electrically connected to the $(4p+3)^{th}$ scan line;

a $(4p+6)^{th}$ stage shift register, comprising an input terminal electrically connected to the output terminal of the $(4p+3)^{th}$ stage shift register and an output terminal electrically connected to the $(4p+6)^{th}$ scan line; and a $(4p+7)^{th}$ stage shift register, comprising an input terminal electrically connected to the output terminal of the $(4p+6)^{th}$ stage shift register and an output terminal electrically connected to the $(4p+7)^{th}$ scan line;

wherein the driving signal is sequentially transmitted to the $(4p+1)^{th}$ scan line, the $(4p+4)^{th}$ scan line, the $(4p+5)^{th}$ scan line and the $(4p+8)^{th}$ scan line in an ascending order of a value of p via the first transmission path and sequentially transmitted to the $(4p+2)^{th}$ scan line, the $(4p+3)^{th}$ scan line, the $(4p+6)^{th}$ scan line and the $(4p+7)^{th}$ scan line in an ascending order of the value of p via the second transmission path, and p includes even integers ranging from 0 to N/4−2.

5. The liquid crystal display apparatus as claimed in claim 1, wherein the scan driving circuit comprises:

a first transmission path, being configured to receive and transmit the driving signal, comprising:

a $(4p+1)^{th}$ stage shift register, comprising an input terminal configured to receive the driving signal and an output terminal electrically connected to the $(4p+1)^{th}$ scan line;

a $(4p+4)^{th}$ stage shift register, comprising an input terminal electrically connected to the output terminal of the $(4p+1)^{th}$ stage shift register and an output terminal electrically connected to the $(4p+4)^{th}$ scan line;

a $(4p+5)^{th}$ stage shift register, comprising an input terminal electrically connected to the output terminal of the $(4p+4)^{th}$ stage shift register and an output terminal electrically connected to the $(4p+5)^{th}$ scan line; and a $(4p+8)^{th}$ stage shift register, comprising an input terminal electrically connected to the output terminal of the $(4p+5)^{th}$ stage shift register and an output terminal electrically connected to the $(4p+8)^{th}$ scan line; and a second transmission path, being connected to the first transmission path and being configured to transmit the driving signal, comprising:

a $(4p+7)^{th}$ stage shift register, comprising an input terminal configured to receive the driving signal and an output terminal electrically connected to the $(4p+7)^{th}$ scan line;

a $(4p+6)^{th}$ stage shift register, comprising an input terminal electrically connected to the output terminal of the $(4p+7)^{th}$ stage shift register and an output terminal electrically connected to the $(4p+6)^{th}$ scan line;

a $(4p+3)^{th}$ stage shift register, comprising an input terminal electrically connected to the output terminal of the $(4p+6)^{th}$ stage shift register and an output terminal electrically connected to the $(4p+3)^{th}$ scan line; and a $(4p+2)^{th}$ stage shift register, comprising an input terminal electrically connected to the output terminal of the $(4p+3)^{th}$ stage shift register and an output terminal electrically connected to the $(4p+2)^{th}$ scan line;

wherein the driving signal is sequentially transmitted to the $(4p+1)^{th}$ scan line, the $(4p+4)^{th}$ scan line, the $(4p+5)^{th}$ scan line and the $(4p+8)^{th}$ scan line in an ascending order of a value of p via the first transmission path and sequentially transmitted to the $(4p+7)^{th}$ scan line, the $(4p+6)^{th}$ scan line, the $(4p+3)^{th}$ scan line and the $(4p+2)^{th}$ scan line in a descending order of the value of p via the second transmission path, and p includes even integers ranging from 0 to N/4−2.

6. A pixel driving method for use in the liquid crystal display apparatus as claimed in claim 1, the pixel driving method comprising the following steps of:

enabling the scan driving circuit to supply a driving signal to the $(4m+1)^{th}$ scan line and the $(4m+4)^{th}$ scan line in an ascending order of a value of m to activate the first pixels and the fourth pixels in the frame; and enabling the scan driving circuit, after all of the first pixels and the fourth pixels have been activated, to sequentially supply the driving signal to the $(4m+2)^{th}$ scan line and the $(4m+3)^{th}$ scan line in an ascending order of the value of m to activate the second pixels and the third pixels in the frame or sequentially supply the driving signal to the $(4m+3)^{th}$ scan line and the $(4m+2)^{th}$ scan line in a descending order of the value of m to activate the third pixels and the second pixels in the frame, wherein the pixel array has an overall scan line amount N, and m includes integers ranging from 0 to N/4−1.

7. The pixel driving method as claimed in claim 6, further comprising the following steps of:

enabling the data driving circuit to supply a first polarity data signal to the data lines to enable the first pixels and the fourth pixels to present a first polarity when the first pixels and the fourth pixels are activated; and enabling the data driving circuit to supply a second polarity data signal to the data lines to enable the second pixels and the third pixels to present a second polarity when the second pixels and the third pixels are activated, wherein the first polarity is opposite to the second polarity.

8. The pixel driving method as claimed in claim 6, wherein the scan driving circuit comprises a first stage shift register to an $N^{th}$ stage shift register, each of the shift registers is electrically connected to the next stage shift register, an output terminal of the first stage shift register to an output terminal of the $(N/2)^{th}$ stage shift register are sequentially electrically connected to the $(4m+1)^{th}$ scan line and the $(4m+4)^{th}$ scan line in an ascending order of the value of m, and an output terminal of the $(N/2+1)^{th}$ stage shift register to an output terminal of the $N^{th}$ stage shift register are sequentially electrically connected to the $(4m+2)^{th}$ scan line and the $(4m+3)^{th}$ scan line in an ascending order of the value of m, the pixel driving method further comprising the following step of:

enabling the first stage shift register to receive the driving signal and sequentially transmit the driving signal to the $N^{th}$ stage shift register so as to sequentially supply the driving signal to the $(4m+1)^{th}$ scan line and the $(4m+4)^{th}$ scan line in an ascending order of the value of m and then sequentially supply the driving signal to the $(4m+2)^{th}$ scan line and the $(4m+3)^{th}$ scan line in an ascending order of the value of m.

9. The pixel driving method as claimed in claim 6, wherein the scan driving circuit comprises a first stage shift register to an $N^{th}$ stage shift register, each of the shift registers is electrically connected to the next stage shift register, an output terminal of the first stage shift register to an output terminal of the $(N/2)^{th}$ stage shift register are sequentially electrically connected to the $(4m+1)^{th}$ scan line and the $(4m+4)^{th}$ scan line in an ascending order of the value of m, and an output terminal of the $(N/2+1)^{th}$ stage shift register to an output terminal of the $N^{th}$ stage shift register are sequentially electrically connected to the $(4m+3)^{th}$ scan line and the $(4m+2)^{th}$ scan line in a descending order of the value of m, the pixel driving method further comprising the following step of:

enabling the first stage shift register to receive the driving signal and sequentially transmit the driving signal to the $N^{th}$ stage shift register so as to sequentially supply the driving signal to the $(4m+1)^{th}$ scan line and the $(4m+4)^{th}$ scan line in an ascending order of the value of m and then sequentially supply the driving signal to the $(4m+3)^{th}$ scan line and the $(4m+2)^{th}$ scan line in a descending order of the value of m.

10. The pixel driving method as claimed in claim 6, wherein the scan driving circuit comprises a first transmission path and a second transmission path, the first transmission path is configured to receive and transmit the driving signal and comprises: a $(4p+1)^{th}$ stage shift register, comprising an input terminal configured to receive the driving signal and an output terminal electrically connected to the $(4p+1)^{th}$ scan line; a $(4p+4)^{th}$ stage shift register, comprising an input terminal electrically connected to the output terminal of the $(4p+1)^{th}$ stage shift register and an output terminal electrically connected to the $(4p+4)^{th}$ scan line; a $(4p+5)^{th}$ stage shift register, comprising an input terminal electrically connected to the output terminal of the $(4p+4)^{th}$ stage shift register and an output terminal electrically connected to the $(4\ p+5)^{th}$ scan line; and a $(4p+8)^{th}$ stage shift register, comprising an input terminal electrically connected to the output terminal of the $(4p+5)^{th}$ stage shift register and an output terminal electrically connected to the $(4p+8)^{th}$ scan line; and the second transmission path is connected to the first transmission path, is configured to transmit the driving signal and comprises: a $(4p+2)^{th}$ stage shift register, comprising an input terminal configured to receive the driving signal and an output terminal electrically connected to the $(4p+2)^{th}$ scan line; a $(4p+3)^{th}$ stage shift register, comprising an input terminal electrically connected to the output terminal of the $(4p+2)^{th}$ stage shift register and an output terminal electrically connected to the $(4p+3)^{th}$ scan line; a $(4p+6)^{th}$ stage shift register, comprising an input terminal electrically connected to the output terminal of the $(4p+3)^{th}$ stage shift register and an output terminal electrically connected to the $(4p+6)^{th}$ scan line; and a $(4p+7)^{th}$ stage shift register, comprising an input terminal electrically connected to the output terminal of the $(4p+6)^{th}$ stage shift register and an output terminal electrically connected to the $(4\ p+7)^{th}$ scan line, the pixel driving method further comprising the following steps of:

enabling the scan driving circuit to transmit the driving signal to the $(4p+1)^{th}$ scan line, the $(4p+4)^{th}$ scan line, the $(4p+5)^{th}$ scan line and the $(4p+8)^{th}$ scan line in an ascending order of the value of p via the first transmission path; and enabling the scan driving circuit to transmit the driving signal to the $(4p+2)^{th}$ scan line, the $(4p+3)^{th}$ scan line, the $(4p+6)^{th}$ scan line and the $(4p+7)^{th}$ scan line in an ascending order of the value of p via the second transmission path;

wherein p includes even integers ranging from 0 to N/4−2.

11. The pixel driving method as claimed in claim 6, wherein the scan driving circuit comprises a first transmission path and a second transmission path, the first transmission path is configured to receive and transmit the driving signal and comprises: a $(4p+1)^{th}$ stage shift register, comprising an input terminal configured to receive the driving signal and an output terminal electrically connected to the $(4p+1)^{th}$ scan line; a $(4p+4)^{th}$ stage shift register, comprising an input terminal electrically connected to the output terminal of the $(4p+1)^{th}$ stage shift register and an output terminal electrically connected to the $(4p+4)^{th}$ scan line; a $(4p+5)^{th}$ stage shift register, comprising an input terminal electrically connected to the output terminal of the $(4p+4)^{th}$ stage shift register and an output terminal electrically connected to the $(4p+5)^{th}$ scan line; and a $(4p+8)^{th}$ stage shift register, comprising an input terminal electrically connected to the output terminal of the $(4p+5)^{th}$ stage shift register and an output terminal electrically connected to the $(4p+8)^{th}$ scan line; and the second transmission path is connected to the first transmission path, is configured to transmit the driving signal and comprises: a $(4p+7)^{th}$ stage shift register, comprising an input terminal configured to receive the driving signal and an output terminal electrically connected to the $(4p+7)^{th}$ scan line; a $(4p+6)^{th}$ stage shift register, comprising an input terminal electrically connected to the output terminal of the $(4\ p+7)^{th}$ stage shift register and an output terminal electrically connected to the $(4p+6)^{th}$ scan line; a $(4p+3)^{th}$ stage shift register, comprising an input terminal electrically connected to the output terminal of the $(4p+6)^{th}$ stage shift register and an output terminal electrically connected to the $(4p+3)^{th}$ scan line; and a $(4p+2)^{th}$ stage shift register, comprising an input terminal electrically connected to the output terminal of the $(4p+3)^{th}$ stage shift register and an output terminal electrically connected to the $(4p+2)^{th}$ scan line, the pixel driving method further comprising the following steps of:

enabling the scan driving circuit to transmit the driving signal to the $(4p+1)^{th}$ scan line, the $(4p+4)^{th}$ scan line, the $(4p+5)^{th}$ scan line and the $(4p+8)^{th}$ scan line in an ascending order of the value of p via the first transmission path; and enabling the scan driving circuit to transmit the driving signal to the $(4p+7)^{th}$ scan line, the $(4p+6)^{th}$ scan line, the $(4p+3)^{th}$ scan line and the $(4p+2)^{th}$ scan line in a descending order of the value of p via the second transmission path;

wherein p includes even integers ranging from 0 to N/4−2.

* * * * *